US012116890B1

(12) United States Patent
Jamison et al.

(10) Patent No.: US 12,116,890 B1
(45) Date of Patent: Oct. 15, 2024

(54) SENSOR ASSEMBLY FOR INTERPRETING MULTIPHASE FLOW IN A FLOWLINE

(71) Applicant: Halliburton Energy Services, Inc., Houston, TX (US)

(72) Inventors: Dale E. Jamison, Houston, TX (US); Andrew Vos, Houston, TX (US); Pyotr Rabochiy, Houston, TX (US); Brian Alan Evans, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/323,047

(22) Filed: May 24, 2023

(51) Int. Cl.

| | |
|---|---|
| ***E21B 47/06*** | (2012.01) |
| ***E21B 47/07*** | (2012.01) |
| ***E21B 49/08*** | (2006.01) |
| ***E21B 49/10*** | (2006.01) |

(52) U.S. Cl.
CPC ..... *E21B 49/0875* (2020.05); *E21B 47/07* (2020.05); *E21B 49/10* (2013.01)

(58) Field of Classification Search
CPC ..... E21B 47/06; E21B 17/00
See application file for complete search history.

(56) References Cited

U.S. PATENT DOCUMENTS

| | | | | |
|---|---|---|---|---|
| 4,532,812 | A * | 8/1985 | Birchak | E21B 47/107 73/152.32 |
| 5,929,342 | A * | 7/1999 | Thompson | G01F 1/66 73/861.04 |
| 7,481,118 | B2 * | 1/2009 | Nyfors | G01F 1/56 73/861 |
| 8,284,075 | B2 * | 10/2012 | Fincher | E21B 47/14 290/1 R |
| 9,238,963 | B2 * | 1/2016 | Frey | G01V 3/20 |
| 9,243,942 | B2 * | 1/2016 | Black | G01F 1/66 |
| 9,279,301 | B2 * | 3/2016 | Lovorn | E21B 47/12 |
| 9,612,145 | B2 * | 4/2017 | Hurmuzlu | G01F 1/667 |
| 9,874,087 | B2 * | 1/2018 | Jay | E21B 47/07 |
| 9,983,150 | B2 * | 5/2018 | Edward | G01F 1/662 |
| 10,465,505 | B2 * | 11/2019 | Disko | E21B 47/12 |
| 10,908,007 | B1 * | 2/2021 | Bukhamseen | G01F 23/263 |

* cited by examiner

*Primary Examiner* — Kenneth L Thompson
(74) *Attorney, Agent, or Firm* — DeLizio, Peacock, Lewin & Guerra, LLP

(57) ABSTRACT

A sensor assembly comprising one or more sensors configured to be radially positioned about a flowline, each of the respective sensors configured to obtain a respective measurement of a fluid flowing through the flowline at a respective position, wherein one or more phase properties of the fluid in the flowline are determined based on the measurements.

20 Claims, 6 Drawing Sheets

SENSOR ASSEMBLY FOR INTERPRETING MULTIPHASE FLOW IN A FLOWLINE

FIELD

Some implementations relate generally to the field of sensors positioned on a flowline and more particularly to the field of measuring fluid properties of fluid in a flowline while drilling a wellbore.

BACKGROUND

In drilling of a wellbore in a subsurface formation, drilling fluids (i.e., drilling mud) may be utilized to model thermal conditions of the wellbore. Thermal modeling of the wellbore may assist in drilling operations and determine possible influx events while drilling the wellbore. Various sensors may be positioned on the surface to measure the properties of fluids, such as temperature, to model the thermal conditions of the wellbore. Successful wellbore thermal modeling may require that the pump suction temperature and the wellbore exiting (flowline) temperature of the drilling fluid system to be measured accurately. Often the flowline temperature may not be measured or may be measured inaccurately, partially due to the multiphase flow conditions that may occur in the flowline. Additionally, the temperature may be measured accurately but may not be reported frequently enough to be used for influx event detection.

BRIEF DESCRIPTION OF THE DRAWINGS

Implementation of the disclosure may be better understood by referencing the accompanying drawings.

DESCRIPTION

Figure 1:
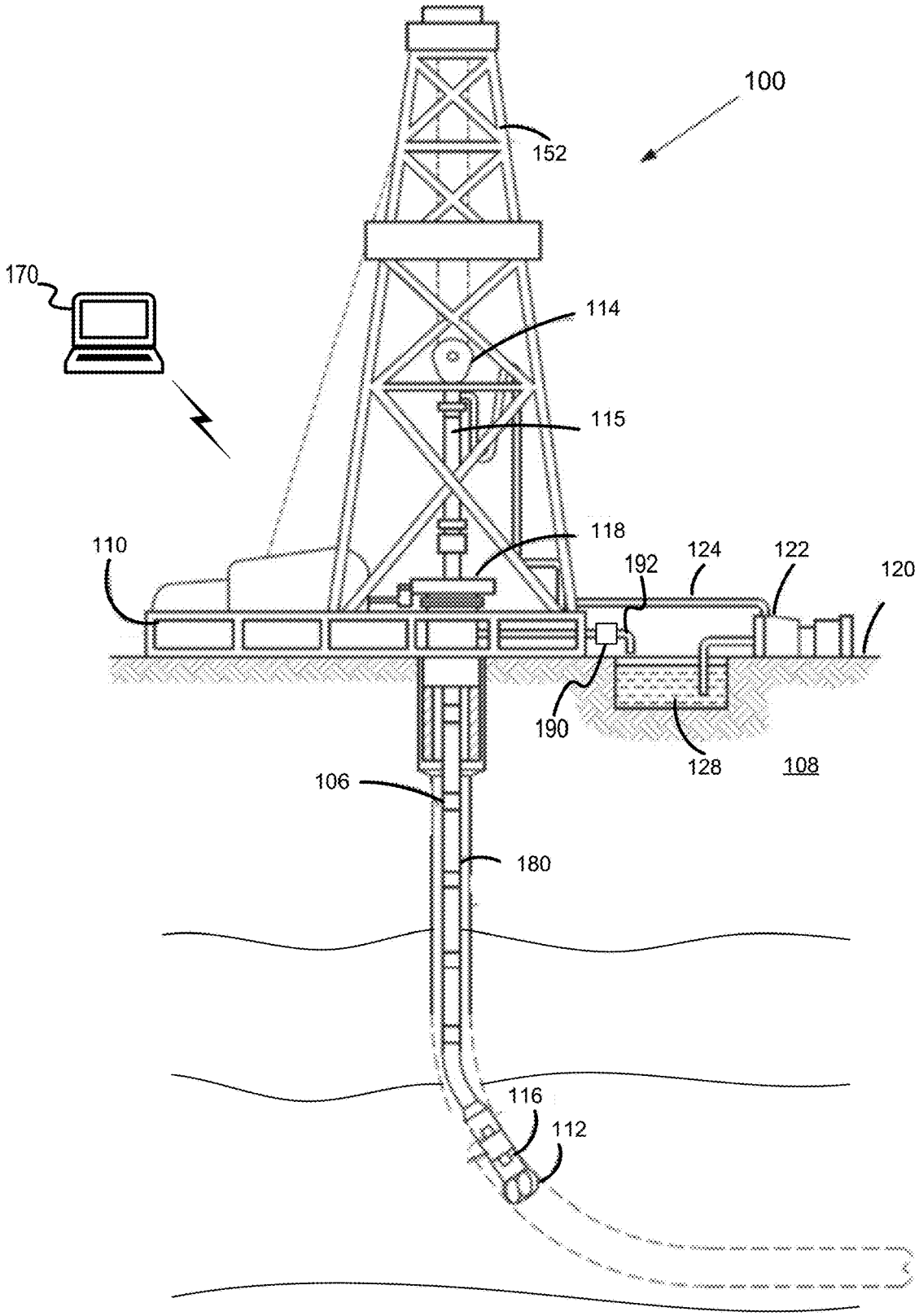
FIG. 1 is an illustration of an example well system, according to some implementations.

The description that follows includes example systems, methods, techniques, and program flows that embody aspects of the disclosure. However, it is understood that this disclosure may be practiced without all the specifics shown in any single drawing or described with respect to any single implementation. Generally, this disclosure refers to one or more temperature sensors radially disposed on a flowline of a drilling rig. Aspects of this disclosure can be applied to any other configuration of sensors disposed on a flowline in hydrocarbon recovery operations. For clarity, some well-known instruction instances, protocols, structures, and techniques have been omitted.

Example implementations relate to obtaining measurements of fluids in a flowline of a drilling system while drilling a wellbore in a subsurface formation. In some implementations, properties of drilling fluids flowing in a flowline of a drilling system may be utilized in various applications including thermal modeling of the wellbore fluids, wellbore pressure management, and influx detection. In some implementations, modeling the thermal conditions of a wellbore may be challenging if the properties (such as temperature) of the fluid in a flowline is unknown or has errors due to multiphase flow conditions in the flowline. For example, an influx of gas from the subsurface formation may result in the fluid in the flowline being multiphasic (such as gas and liquid). In some implementations, a sensor assembly including one or more sensors may be positioned on the flowline. Such implementations may allow for measurements of each phase of the multiphase fluid in the flowline to be obtained. The measurements may allow for more accurate thermal modeling of the wellbore fluids, wellbore pressure management, and influx detection.

Some implementations may include one or more sensors radially positioned about a flowline. Each of the respective sensors may be configured to obtain a respective measurement of the fluid flowing through the flowline at a respective position. For example, temperature sensors and/or thermal conductivity sensors may be radially positioned such that measurements of each phase of fluid in the flowline may be obtained. The measurements obtained by each sensor may vary due to the conditions of the multiphasic fluid including varying thermal conditions of each phase within the fluid, the type and/or composition of drilling mud, possible gas influx from the subsurface formation, etc. For example, a temperature measurement obtained by a sensor positioned proximate a fluid phase may differ from a temperature measurement obtained by another sensor positioned proximate a gas phase. In some implementations, the flowline may be full (i.e., single phase fluid) and the measurements obtained by each sensor may be similar.

In some implementations, one or more phase properties of the fluid in the flowline may be determined based on the measurements obtained by each of the sensors. The one or more phase properties may include the temperature and/or pressure of each respective phase of fluid. In some implementations, analytics and/or other physics based methods may interpret the measurements to determine the phase properties. For example, the interpretation may include the temperature of the fluid in the flowline and the probability of gas presence in the flowline. The interpretation of the measurements may provide a complete representation of the flowline temperature that may be utilized for modeling thermal conditions of the wellbore. In some implementations, the thermal modeling of the wellbore may be critical for drilling optimization and downhole pressure management. Additionally, the phase properties of the fluid may also be useful for event detection such as gas influx into the wellbore.

In some implementations, drilling operations may be performed based on the phase properties. For example, the phase properties may indicate an influx event may have occurred due to the influx event triggering compositional changes in the fluid system over a period of time. Accordingly, the influx may be treated by increasing the mud weight of the drilling fluid.

Example Systems

FIG. 1 is an illustration of an example well system, according to some implementations. In particular, FIG. 1 is a schematic diagram of a well system 100 that includes a drill string 180 having a drill bit 112 disposed in a wellbore 106 for drilling the wellbore 106 in the subsurface formation 108. While depicted for a land-based well system, example implementations may be used in subsea operations that employ floating or sea-based platforms and rigs.

The well system 100 may further include a drilling platform 110 that supports a derrick 152 having a traveling block 114 for raising and lowering the drill string 180. The drill string 180 may include, but is not limited to, drill pipe, drill collars, and drilling assembly 116. The drilling assembly 116 may comprise any of a number of different types of tools including a rotary steerable system (RSS), measurement while drilling (MWD) tools, logging while drilling (LWD) tools, mud motors, etc. A kelly 115 may support the drill string 180 as it may be lowered through a rotary table 118. The drill bit 112 may include roller cone bits, polycrystalline diamond compact (PDC) bits, natural diamond bits, any hole openers, reamers, coring bits, and the like. Drilling parameters of drilling the wellbore 106 may be adjusted to increase, decrease, and/or maintain the rate of penetration (ROP) of the drill bit 112 through the subsurface formation 108 and, additionally, steer the drill bit 112 through the subsurface formation 108. Drilling parameters may include weight-on-bit (WOB) and rotations-per-minute (RPM) of the drill string 180.

A pump 122 may circulate drilling fluid through a feed pipe 124 to the kelly 116, downhole through interior of the drill string 180, through orifices in the drill bit 112, back to the surface 120 via an annulus surrounding the drill string 180, and into a retention pit 128 via flowline 192. A sensor 190 may be positioned on the flowline 192 to obtain measurements of the drilling fluid as it returns to the surface 120 from the wellbore. In some implementations, the drilling fluid may include drilling mud, cuttings from the subsurface formation, reservoir fluids, etc.

Figure 6:
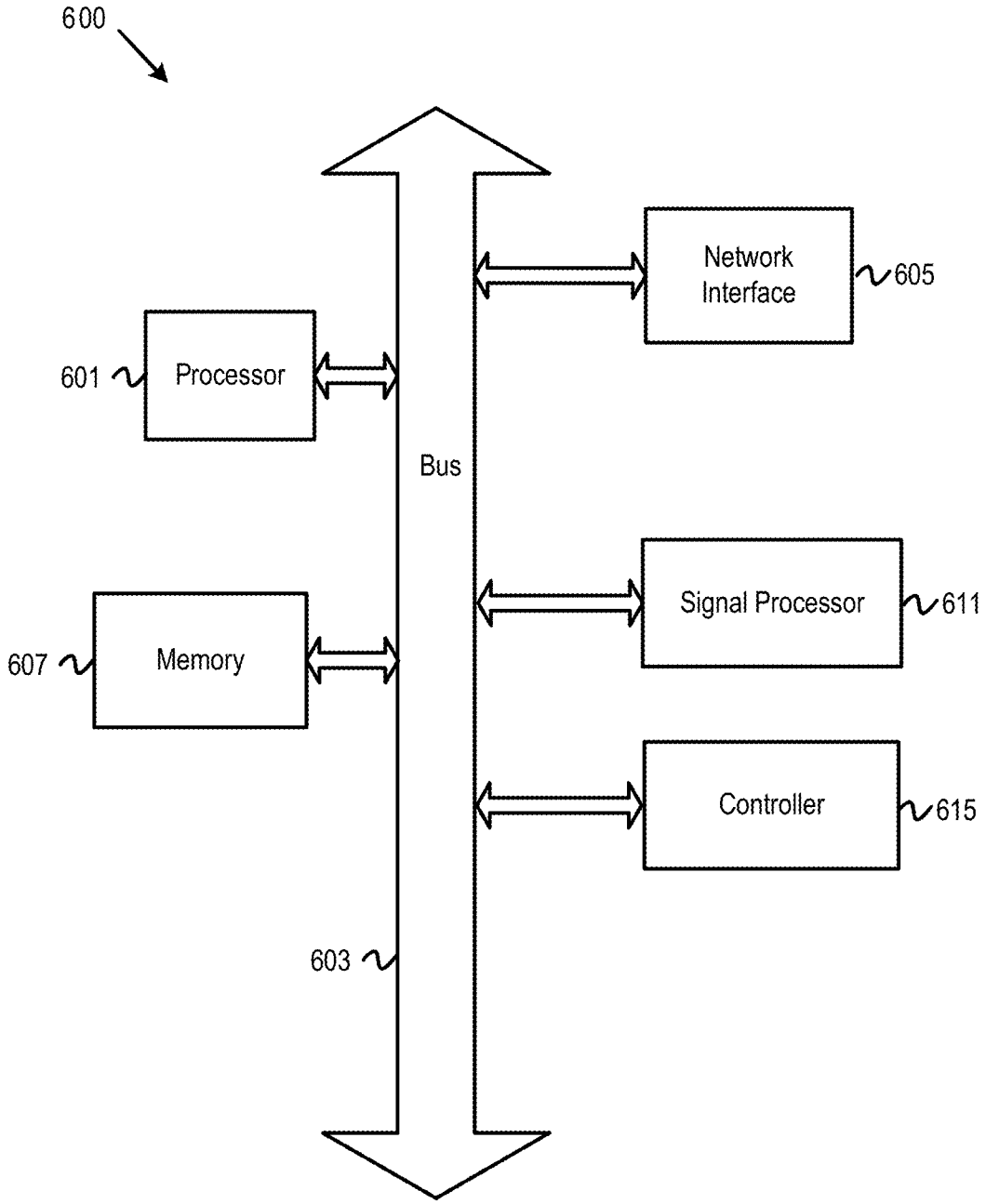
FIG. 6 is a block diagram depicting an example computer, according to some implementations.

The well system 100 includes a computer 170 that may be communicatively coupled to other parts of the well system 100. The computer 170 may be local or remote to the drilling platform 110. A processor of the computer 170 may perform simulations (as further described below). In some implementations, the processor of the computer 170 may control drilling operations of the well system 100 or subsequent drilling operations of other wellbores. For instance, the processor of the computer 170 may determine phase properties of the drilling fluid flowing through the flowline 192 based on measurements obtained from the sensor 190 and control drilling operations based on the phase properties of the drilling fluid. An example of the computer 170 is depicted in FIG. 6, which is further described below.

Example Sensor

Examples of a sensor assembly are now described. The sensor assembly is described in reference to the sensor 190 and of FIG. 1.

Figure 2B:
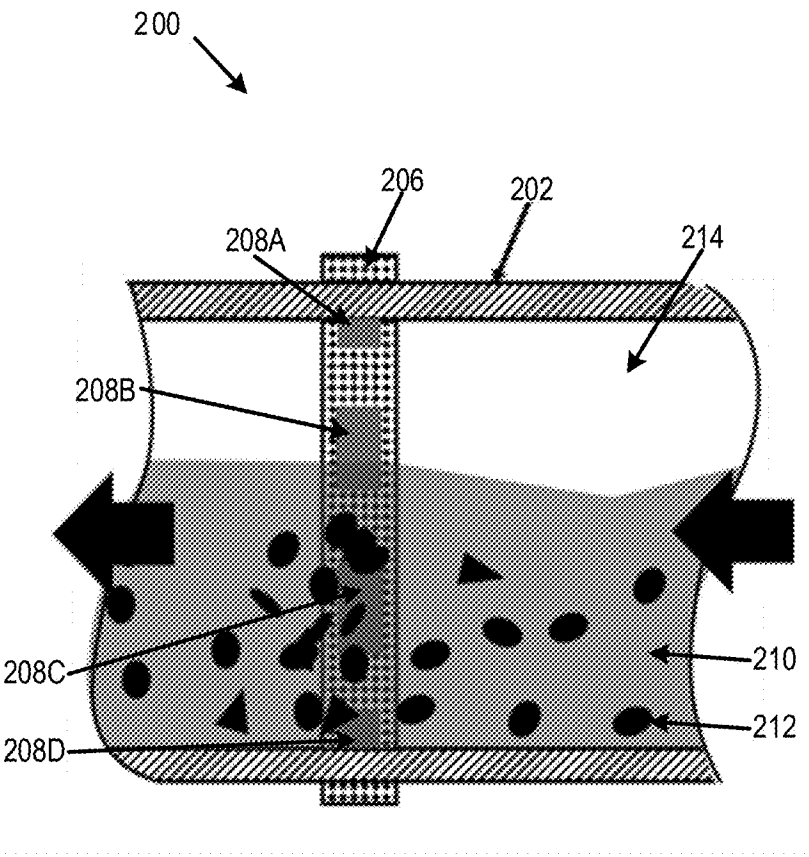
FIGS. 2A-2B are illustrations of an example sensor assembly, according to some implementations.
Figure 2A:
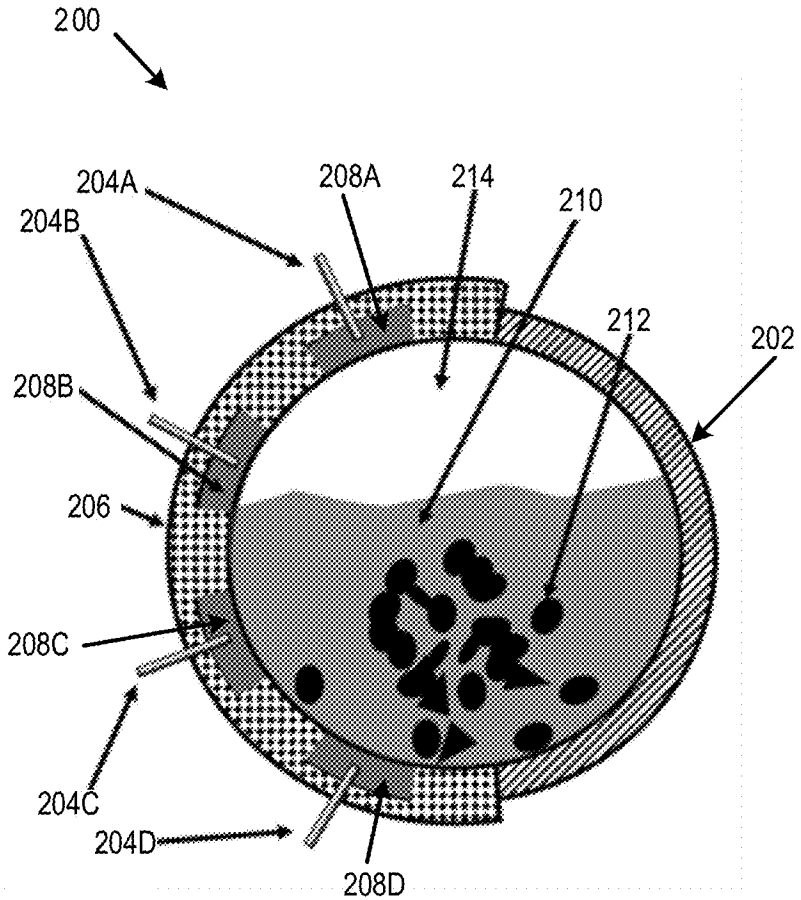

FIGS. 2A-2B are illustrations of an example sensor assembly, according to some implementations. In particular, FIGS. 2A-2B depict cross sectional views of an example sensor assembly 200. The sensor assembly 200 may be configured to obtain measurements of the fluid as it flows through the flowline 202. In some implementations, the fluid flowing through the flowline may be multiphasic. For example, the fluid may include a liquid phase, such as drilling mud 210, and a gas phase, such as vapor phase 214, that may include vaporized mud components and/or influx gases from the subsurface formation. In some implementations, influx gases may be dissolved in the drilling mud 210. Cuttings 212 that may have been removed from the wellbore may be present in the flowline. In some implementations, fluid in the flowline may be single phase. For example, the entire internal bore of the flowline 202 may be full of drilling mud 210.

The sensor assembly 200 includes sensors 204A-D radially positioned about a flowline 202. The sensors 204A-D may include temperature sensors, thermal conductivity sensors, electrical conductivity sensors, acoustic sensors, ultrasonic sensors, etc. or a combination of the like. FIGS. 2A-2B depict four sensors positioned partially about the central axis of the flowline 202 for illustrative purposes. One or more sensors may be radially positioned about the circumference of flowline such that measurements of each phase may be obtained. Each of the respective sensors 204A-D may be configured to obtain respective measurements of fluid at respective positions in the flowline. Measurements may include temperature measurements, thermal conductivity measurements, acoustic measurements, ultrasonic measurements, etc. For example, the sensor 204A may obtain a measurement corresponding to the gas phase (vapor phase 214) and the sensor 204D may obtain a measurement corresponding to the liquid phase (drilling mud 210). In some implementations, the measurements obtained by the sensors 204A-D may be similar if the flowline is full of drilling mud (i.e., a single phase fluid). If the fluid becomes multiphasic (i.e., includes vapor 214 and drilling mud 210), the measurements obtained by the sensors 204A-D may vary depending on the thermal conditions of the drilling mud 210, the type and/or composition of the drilling mud 210, possible influx of gas from the subsurface formation, etc.

In some implementations, the sensors 204A-D may be isolated from the flowline 202 by an insulator 206. Each of the sensors 204A-D may be embedded in a high thermal conductivity material such as copper, beryllium copper, etc. The high thermal conductivity material 208A-D may enable a faster response time than if the sensors 204A-D were not embedded in the high thermal conductivity material 208A-D. The high thermal conductivity material 208A-D may have a continuous contour with the internal diameter of the flowline 202. For example, the internal diameter of the flowline 202 may be constant due to the high thermal conductivity material 208A-D being continuously contoured with the flowline 202 internal diameter.

In some implementations, the sensor assembly 200 may include a heat source (not pictured) to provide a measure of fluid velocity in each of the sections of fluid. The heat source may effectively configure the sensor assembly 200 to be a thermal conductivity sensor. Thus, the rate of heat dissipation from the sensor may be impacted by the convective boundary layer. The convective properties of the possible phases and mixtures thereof may conduct heat away at different rates thus providing more data to define the flowing components and mixtures at each sensor location.

In some implementations, the sensor assembly 200 may be configured to be intrinsically safe for hazardous conditions. For example, the sensor assembly 200 may be configured to withstand high temperature environments, environments with hazardous and/or corrosive gases, etc.

Example Operations

Figure 3:
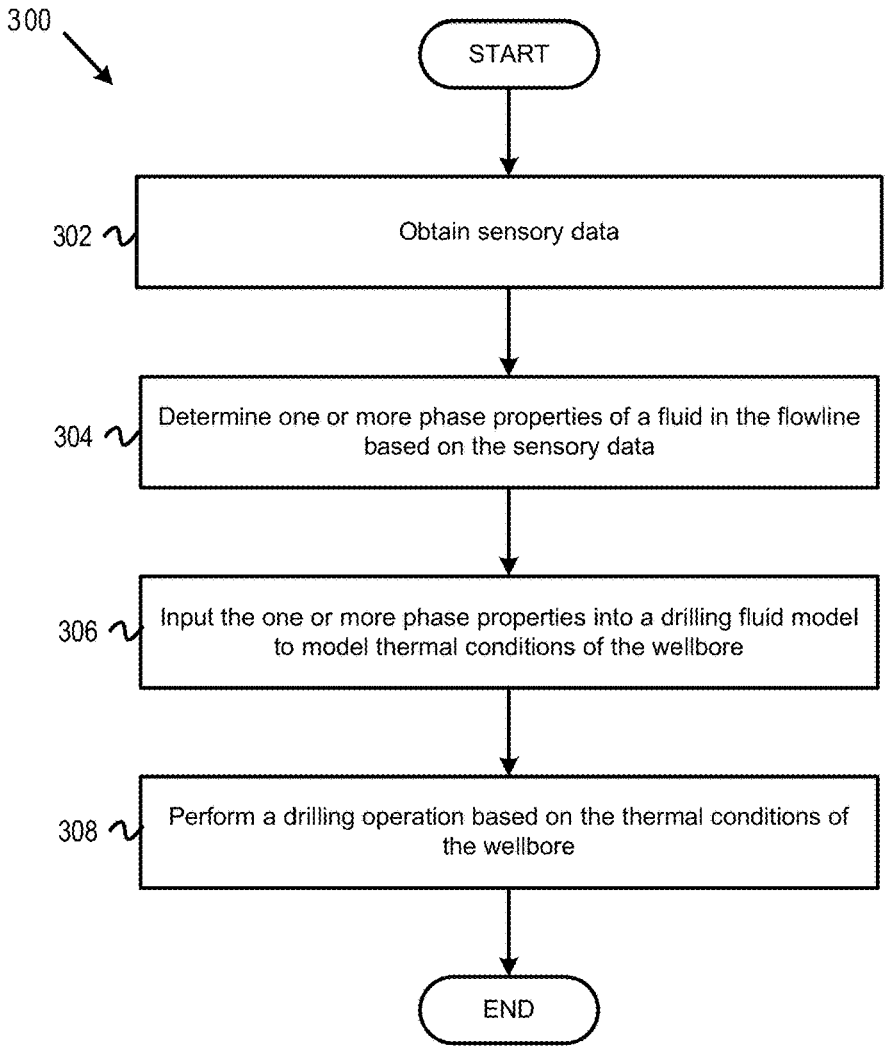
FIG. 3 is a flowchart of example operations for obtaining measurements with one or more sensors, according to some implementations.

FIG. 3 is a flowchart of example operations for obtaining measurements with one or more sensors, according to some implementations. FIG. 3 depicts a flowchart 300 of operations to obtain measurements of fluid flowing through a flowline via sensors radially positioned about a flowline. The operations of flowchart 300 are described in reference the sensor 190 and computer 170 of FIG. 1 and sensor assembly 200 of FIGS. 2A-2B. Additionally, the operations of flowchart 300 are described in reference to FIG. 4 and FIGS. 5A-B. Operations of the flowchart 300 begin at block 302.

At block 302, sensory data may be obtained. The sensory data may include respective measurements from respective sensors positioned on a flowline (such as the one or more sensors 204A-D of FIG. 2). The measurements may include temperature measurements, thermal conductivity measurements, etc. or a combination of the like. The sensory data may also include drilling attributes. Drilling attributes may include rate-of-penetration (ROP), rotations-per-minute (RPM), torque-on-bit (TOB), pump inlet temperature, downhole pressure, downhole temperature, etc. In some implementations, the sensory data may be obtained by a fluid monitoring system such as a Baralogix density and rheology unit (DRU) system. In some implementations, the data gathering system may report the sensory data to a database, such as a cloud database, to be stored.

At block 304, one or more phase properties of a fluid in the flowline may be determined based on the sensory data. The one or more phase properties of the fluid in the flowline may include pressure and temperature of each respective phase of the fluid in the flowline, the volume of gas in the flowline, the volume of gas in solution, etc. The phase properties may indicate the probability of gas presence in the flowline. For example, if the fluid includes a gas phase and a liquid phase, pressure and temperature for the gas phase and the liquid phase may be determined. In some implementations, a physics based model may be utilized to determine the phase properties.

Figure 4:
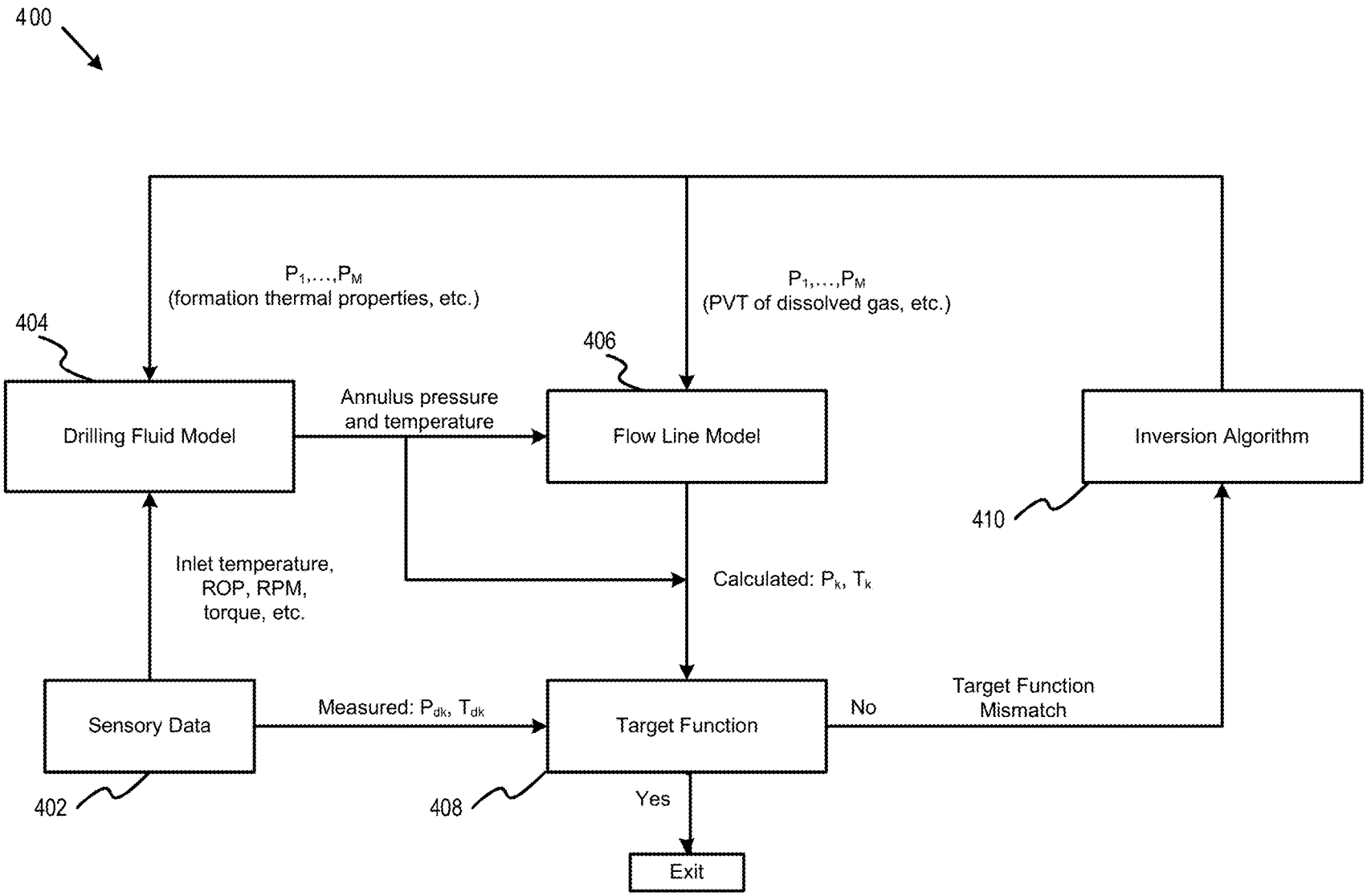
FIG. 4 is a block diagram of a model for analysis of sensory data, according to some implementations.

To help illustrate, FIG. 4 is a block diagram of a model for analysis of sensory data, according to some implementations. In particular, FIG. 4 includes a physics based model 400 for determining the phase properties of the fluid in the flowline at a current step (i.e., time period) k. The physics based model may utilize sensory data to calibrate a flowline model 406 and transient temperature models. FIG. 4 is described in reference to the computer 170 of FIG. 1.

Drilling attributes of sensory data 402 such as inlet temperature, ROP, RPM, TOB, etc. may be input into a drilling fluid model 404. In some implementations, the drilling fluid model 404 may be a drilling fluid graphics system (DFG) that includes hydraulic and transient temperature models. The drilling fluid model 404 may determine one or more wellbore properties of the wellbore based on the sensory data 402 including the annulus pressure and annulus temperature of the wellbore.

A flowline model 406 may be configured to generate the phase properties of the fluid in the flowline. In some implementations, the flowline model may be governed by Equations 1-4:

$$\frac{\partial}{\partial_t}(\rho_i A_i) + \frac{\partial}{d_z}(\rho_i A_i v_i) = 0 \tag{1}$$

$$\frac{\partial}{\partial_z}(\rho_i A_i v_i) = -\left(\frac{\partial P}{\partial_z} + \rho_i g\left(\sin\alpha + \cos\alpha\frac{\partial h}{\partial_z}\right)\right)A_i \pm \tau_{lg}S_{lg} - \tau_i S_i \tag{2}$$

$$\rho_i C_{pi} v_i\left(\frac{\partial T_i}{\partial_z} + v_i\frac{\partial P}{\partial_z}\right) = S_i U_i(T_\alpha - T_i) \pm (S_{lg}U_{lg} - C_{pg}Q_{lg})(T_g - T_i) \tag{3}$$

$$\frac{\partial h}{\partial_z} = -\frac{A_t\dfrac{\left(\partial\dfrac{B_g B_s}{B_t}\right)}{\delta P}}{\left(\dfrac{\partial A_t}{\delta h}\right)\left(1 + \dfrac{B_g B_s}{B_t}\right)}\frac{\partial P}{\partial_z},\ \dot{Q} = S_{l,g}\frac{\partial h}{\partial t},\ \rho_g = \frac{M_g P}{z_g RT},\ i = l, g \tag{5}$$

Where P is pressure Ti is temperature for the i-th phase, $\rho_i$ is density for the i-th phase, $v_i$ is velocity for the i-th phase, $\tau_i$ is wall shear stress for the i-th phase, $A_i$ is cross section area for the i-th phase, $S_i$ is surface area for the i-th phase, $V_i$ is volume for the i-th phase, $C_{pi}$ is heat capacity for the i-th phase, $U_i$ is overall hear transfer coefficient for the i-th phase, B; is formation volume factor for the i-th phase, Sig is area of the surface between the liquid and gas phase, $U_{lg}$, is heat transfer coefficient between liquid and gas phase, and $t_{lg}$ is shear stress between the liquid and gas phase, R, is solubility of gas, $Z_g$ is compressibility of gas, $M_g$ is molar mass of gas, h is height of the liquid phase, and $T_a$ is the ambient temperature.

Figure 5B:
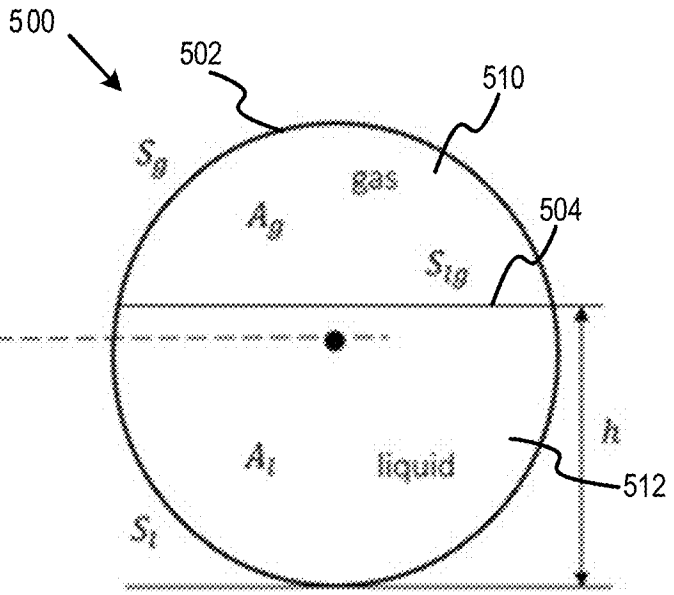
FIGS. 5A-B are illustrations of an example multiphasic fluid system, according to some implementations.
Figure 5A:
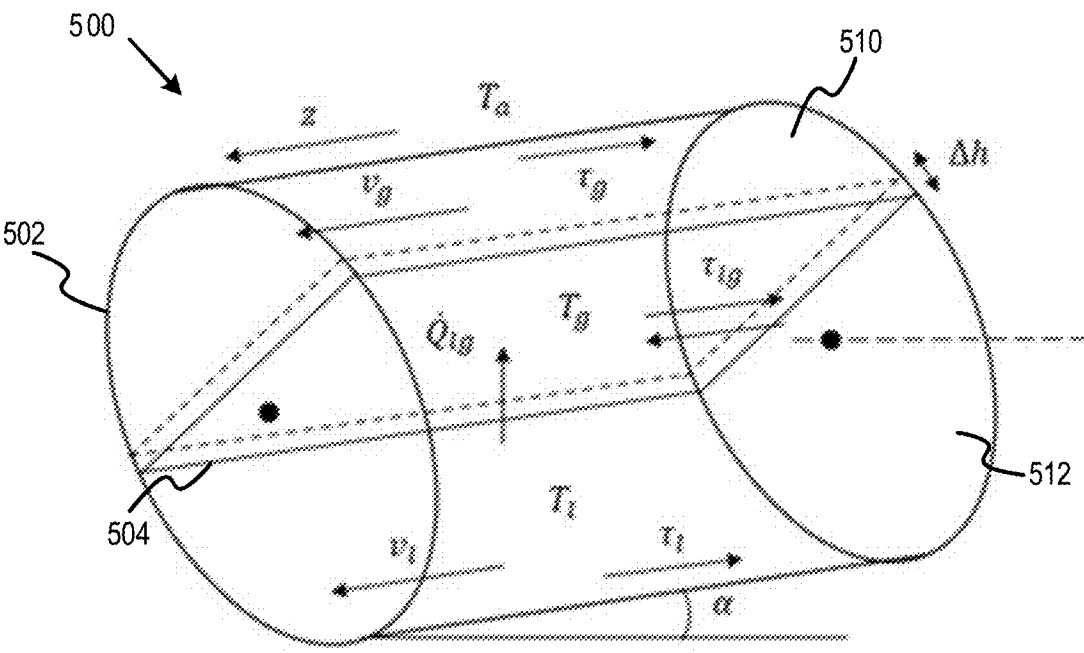

The flowline model 406 may be based on equations of a multiphasic fluid system including mass, momentum, and heat balance equations. To help illustrate, FIGS. 5A-B are illustrations of an example multiphasic fluid system, according to some implementations. FIGS. 5A-B depict and example multiphasic fluid system 500 that includes a flowline section 502. The flowline section 502 includes a gas phase 510 and a liquid phase 512 separated by an interface 504.

Returning to FIG. 4, the flowline model 406, configured with the governing equations described above, may utilize the annulus pressure and annulus temperature generated by the drilling fluid model 404 as boundary conditions to generate the phase properties of each phase of fluid in the flowline (e.g., pressure and temperature of each respective phase of fluid at the current time period).

In some implementations, the phase properties may be identified via model calibration by the sensory data 402. For example, the phase properties may be input into a target function 408. Additionally, the measured downhole pressure and downhole temperature may also be input into the target function for comparison to the calculated phase properties. The target function may be represented by Equation 5:

$$\sum_{k=1}^{N} w_{Tk}(T_k - T_{dk})^2 + w_{Pk}(P_k - P_{dk})^2 < \varepsilon \tag{5}$$

where ε is the error threshold. If the output of the target function is less than an error threshold, then the calibration of the flowline model and the drilling fluid model for the current time period may be satisfied. Otherwise, the flowline model and the drilling fluid model may be calibrated with inversion algorithm 410. The inversion algorithm may be represented by Equations 6:

$$p_1 = p_1 + \Delta p_1 \ldots p_m = p_m + \Delta p_m \tag{6}$$

where $p_1 \ldots p_m$ is a set of parameters of the flowline and transient temperature models identified via calibration by the sensory data 402. The flowline model 406 may be calibrated with parameters including pressure-volume-temperature (PVT) of dissolved gas. The models of the drilling fluid model 404 may be calibrated via parameters including formation thermal properties.

In some implementations, the phase properties may be utilized as input parameters into a drilling fluid model to model thermal conditions in the wellbore, as described below.

Returning to operations of flowchart 300, at block 306, the one or more phase properties may be input into a drilling fluid model to model the thermal conditions of the wellbore. The phase properties, such as temperature of the fluid, may be utilized as a boundary condition for the modeling of the thermal conditions in the wellbore. The thermal conditions of the wellbore may include the temperature of the fluid (e.g., drilling fluid) in the wellbore. The drilling fluid model may include a hydraulics model, a transient thermal model, an influx detection, etc. to model the thermal conditions. In some implementations, the modeling of the thermal conditions of the wellbore may be utilized for drilling optimization and downhole pressure management. For example, the thermal modeling may indicate the thermal conditions of the wellbore may be affecting the drilling mud properties, such as viscosity, that may have a negative impact on drilling operations. For instance, the thermal conditions may cause the drilling mud to lose the ability to carry cuttings to surface which may result in damage to the wellbore or drilling tools positioned in the wellbore. In some implementations, the influx detection may indicate an influx event where formation fluids (e.g., gas) have entered the annulus of the wellbore. For example, the influx detection may determine, based on the volume of gas in the flowline, that the subsurface formation pressure may be greater than the annulus pressure of the wellbore at the subsurface formation, and an influx of gas from the subsurface formation may have entered the annulus of the wellbore.

At block 308, a drilling operation may be performed based on the thermal conditions of the wellbore. Drilling operations may include a change in operation parameters such as a change in the flow rate of the drilling mud, a change in ROP, a change in RPM, shut in the wellbore, perform wellbore strengthening, etc. For example, flow rate of the drilling mud may be increased to assist in the drilling mud carrying cutting to surface if the thermal conditions have negatively impacted the drilling mud properties. Drilling operations may also include treating the drilling mud system such as increasing the weight of the drilling mud, adding viscosity modifier to the drilling mud, adding lost circulation material (LCM) and/or strengthening material to the drilling mud, etc. For example, the drilling mud weight may be increased to increase the annular pressure of the wellbore such that the annular pressure is approximately equal to or greater than the subsurface formation pressure to prevent the occurrence of an influx event and/or keep subsurface formation gas dissolved in the drilling mud.

Example Computer

FIG. 6 is a block diagram depicting an example computer, according to some implementations. FIG. 6 depicts a computer 600 for obtaining and interpreting measurements of a fluid in a flowline. The computer 600 includes a processor 601 (possibly including multiple processors, multiple cores, multiple nodes, and/or implementing multi-threading, etc.). The computer 600 includes memory 607. The memory 607 may be system memory or any one or more of the above already described possible realizations of machine-readable media. The computer 600 also includes a bus 603 and a network interface 605. The computer 600 can communicate via transmissions to and/or from remote devices via the network interface 605 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 600 also includes a signal processor 611 and a controller 615 which may perform the operations described herein. For example, the signal processor 611 may obtain measurements from one or more sensors radially positioned about a flowline and determine phase properties of the fluid. The controller 615 may perform a drilling operation based on the phase properties. The signal processor 611 and the controller 615 can be in communication. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, techniques for seismic horizon mapping as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

EXAMPLE IMPLEMENTATIONS

Implementation #1: A sensor assembly comprising: one or more sensors configured to be radially positioned about a flowline, each of the respective sensors configured to obtain a respective measurement of a fluid flowing through the flowline at a respective position, wherein one or more phase properties of the fluid in the flowline are determined based on the measurements.

Implementation #2: The sensor assembly of Implementation #1, wherein the one or more sensors include a temperature sensor, thermal conductive sensor, an acoustic sensor, and an ultrasonic sensor.

Implementation #3: The sensor assembly of claim Implementation #1 or #2 further comprising an insulator configured to isolate the one or more sensors from the flowline.

Implementation #4: The sensor assembly of any one or more of Implementations #1-3, wherein each of the one or more sensors is embedded in a thermal conductive material, and wherein a contour of the thermal conductive material is continuous with an inside diameter of the flowline.

Implementation #5: The sensor assembly of any one or more of Implementations #1-4, wherein the thermal conductive material includes copper and beryllium copper.

Implementation #6: The sensor assembly of any one or more of Implementations #1-5 further comprising: determination of the one or more phase properties of the fluid in the flowline, via a flowline multiphase model, based on the measurements; determination of thermal conditions in a wellbore based on the one or more phase properties; and performance of a drilling operation based on the thermal conditions of the wellbore.

Implementation #7: The sensor assembly of any one or more of Implementations #1-6, wherein the one or more phase properties of the fluid in the flowline includes a first temperature or a first phase of the fluid, and a first pressure of the first phase of the fluid.

Implementation #8: The sensor assembly of any one or more of Implementations #1-7, the determination of the one or more phase properties of the fluid further comprising: determination of one or more wellbore properties of a wellbore, via a drilling fluid model, based on sensory data including the measurements and one or more drilling attributes, wherein the one or more wellbore properties include an annulus pressure and an annulus temperature; and input of the one or more wellbore properties into a flowline multiphase model to generate the one or more phase properties of the fluid in the flowline.

Implementation #9: The sensor assembly of Implementation #8, wherein an inversion algorithm calibrates the flowline multiphase model and the drilling fluid model based on the sensory data.

Implementation #10: A method comprising: positioning one or more sensors on a flowline, wherein the one or more sensors are radially positioned about the flowline; obtaining, with each of the respective sensors, a respective measurement of a fluid flowing through the flowline at a respective position; determining one or more phase properties of the fluid in the flowline based on the measurements; and performing a drilling operation based on the one or more phase properties.

Implementation #11: The method of Implementation #10 further comprising: determining the one or more phase properties of the fluid in the flowline, via a flowline multiphase model, based on the measurements; determining thermal conditions in a wellbore based on the one or more phase properties; and performing the drilling operation based on the thermal conditions of the wellbore.

Implementation #12: The method of Implementation #10 or #11, wherein the one or more phase properties of the fluid in the flowline includes a first temperature or a first phase of the fluid, and a first pressure of the first phase of the fluid.

Implementation #13: The method of any one or more of Implementations #10-12, the determining the one or more phase properties of the fluid further comprising: determining one or more wellbore properties of a wellbore, via a drilling fluid model, based on sensory data including the measurements and one or more drilling attributes, wherein the one or more wellbore properties include an annulus pressure and an annulus temperature; and inputting the one or more wellbore properties into a flowline multiphase model to generate the one or more phase properties of the fluid in the flowline.

Implementation #14: The method of Implementation #13, wherein an inversion algorithm calibrates the flowline multiphase model and the drilling fluid model based on the sensory data.

Implementation #15: A system comprising: a flowline; and one or more sensors radially positioned about the flowline, each of the respective sensors configured to obtain a respective measurement of a fluid flowing through the flowline at a respective position, wherein one or more phase properties of the fluid in the flowline are determined based on the measurements.

Implementation #16: The system of Implementation #15, wherein the one or more sensors include a temperature sensor, thermal conductive sensor, an acoustic sensor, and an ultrasonic sensor.

Implementation #17: The system of Implementation #15 or #16 further comprising an insulator configured to isolate the one or more sensors from the flowline.

Implementation #18: The system of any one or more of Implementations #15-17, wherein each of the one or more sensors is embedded in a thermal conductive material, and wherein a contour of the thermal conductive material is continuous with an inside diameter of the flowline.

Implementation #19: The system of Implementation #18, wherein the thermal conductive material includes copper and beryllium copper.

Implementation #20: The system of any one or more of Implementations #15-19, wherein the one or more phase properties of the fluid in the flowline includes a first temperature or a first phase of the fluid, and a first pressure of the first phase of the fluid.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A sensor assembly comprising:

one or more sensors configured to be radially positioned about a flowline, each of the respective sensors configured to obtain a respective measurement of a fluid flowing through the flowline at a respective position, wherein each of the one or more sensors is embedded in a thermal conductive material, and wherein one or more phase properties of the fluid in the flowline are determined based on the measurements.

2. The sensor assembly of claim 1, wherein the one or more sensors include a temperature sensor, thermal conductive sensor, an acoustic sensor, and an ultrasonic sensor.

3. The sensor assembly of claim 1 further comprising an insulator configured to isolate the one or more sensors from the flowline.

4. The sensor assembly of claim 1, wherein a contour of the thermal conductive material is continuous with an inside diameter of the flowline.

5. The sensor assembly of claim 1, wherein the thermal conductive material includes copper and beryllium copper.

6. The sensor assembly of claim 1 further comprising:

determination of the one or more phase properties of the fluid in the flowline, via a flowline multiphase model, based on the measurements;

determination of thermal conditions in a wellbore based on the one or more phase properties; and performance of a drilling operation based on the thermal conditions of the wellbore.

7. The sensor assembly of claim 1, wherein the one or more phase properties of the fluid in the flowline includes a first temperature or a first phase of the fluid, and a first pressure of the first phase of the fluid.

8. The sensor assembly of claim 1, the determination of the one or more phase properties of the fluid further comprising:

determination of one or more wellbore properties of a wellbore, via a drilling fluid model, based on sensory data including the measurements and one or more drilling attributes, wherein the one or more wellbore properties include an annulus pressure and an annulus temperature; and input of the one or more wellbore properties into a flowline multiphase model to generate the one or more phase properties of the fluid in the flowline.

9. The sensor assembly of claim 8, wherein an inversion algorithm calibrates the flowline multiphase model and the drilling fluid model based on the sensory data.

10. A method comprising:

positioning one or more sensors on a flowline, wherein the one or more sensors are radially positioned about the flowline, and wherein each of the one or more sensors is embedded in a thermal conductive material;

obtaining, with each of the respective sensors, a respective measurement of a fluid flowing through the flowline at a respective position;

determining one or more phase properties of the fluid in the flowline based on the measurements; and performing a drilling operation based on the one or more phase properties.

11. The method of claim 10 further comprising:

determining the one or more phase properties of the fluid in the flowline, via a flowline multiphase model, based on the measurements;

determining thermal conditions in a wellbore based on the one or more phase properties; and performing the drilling operation based on the thermal conditions of the wellbore.

12. The method of claim 10, wherein the one or more phase properties of the fluid in the flowline includes a first temperature or a first phase of the fluid, and a first pressure of the first phase of the fluid.

13. The method of claim 10, the determining the one or more phase properties of the fluid further comprising:

determining one or more wellbore properties of a wellbore, via a drilling fluid model, based on sensory data including the measurements and one or more drilling attributes, wherein the one or more wellbore properties include an annulus pressure and an annulus temperature; and inputting the one or more wellbore properties into a flowline multiphase model to generate the one or more phase properties of the fluid in the flowline.

14. The method of claim 13, wherein an inversion algorithm calibrates the flowline multiphase model and the drilling fluid model based on the sensory data.

15. A system comprising:

a flowline; and one or more sensors radially positioned about the flowline, each of the respective sensors configured to obtain a respective measurement of a fluid flowing through the flowline at a respective position, wherein each of the one or more sensors is embedded in a thermal conductive material, and wherein one or more phase properties of the fluid in the flowline are determined based on the measurements.

16. The system of claim 15, wherein the one or more sensors include a temperature sensor, thermal conductive sensor, an acoustic sensor, and an ultrasonic sensor.

17. The system of claim 15 further comprising an insulator configured to isolate the one or more sensors from the flowline.

18. The system of claim 15, wherein a contour of the thermal conductive material is continuous with an inside diameter of the flowline.

19. The system of claim 15, wherein the thermal conductive material includes copper and beryllium copper.

20. The system of claim 15, wherein the one or more phase properties of the fluid in the flowline includes a first temperature or a first phase of the fluid, and a first pressure of the first phase of the fluid.

* * * * *